US011319739B2

(12) United States Patent
Yasuda et al.

(10) Patent No.: US 11,319,739 B2
(45) Date of Patent: May 3, 2022

(54) STAY

(71) Applicant: SUGATSUNE KOGYO CO., LTD., Tokyo (JP)

(72) Inventors: Kazuhiro Yasuda, Tokyo (JP); Takuma Komoto, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 17/250,288

(22) PCT Filed: May 16, 2019

(86) PCT No.: PCT/JP2019/019419
§ 371 (c)(1),
(2) Date: Dec. 28, 2020

(87) PCT Pub. No.: WO2020/003790
PCT Pub. Date: Jan. 2, 2020

(65) Prior Publication Data

US 2021/0262271 A1 Aug. 26, 2021

(30) Foreign Application Priority Data

Jun. 29, 2018 (JP) ..... JP2018-125467

(51) Int. Cl.
*E05F 1/08* (2006.01)
*E05F 1/14* (2006.01)
*E05C 17/32* (2006.01)

(52) U.S. Cl.
CPC ..... *E05F 1/14* (2013.01); *E05C 17/32* (2013.01)

(58) Field of Classification Search
CPC ..... Y10T 16/5323; Y10T 16/53834; Y10T 16/53885; Y10T 16/5406; Y10T 16/543;
(Continued)

(56) References Cited

U.S. PATENT DOCUMENTS 2,777,156 A * 1/1957 Weisgarber ..... E05D 3/022 16/361
3,867,739 A 2/1975 Schnuell et al.
(Continued)

FOREIGN PATENT DOCUMENTS

JP 2015209755 A 11/2015
WO 2017221716 A1 12/2017

OTHER PUBLICATIONS

WIPO, Japan Patent Office International Search Authority, International Search Report (with English translation) and Written Opinion dated Jun. 25, 2019 in International Patent Application No. PCT/JP2019/019419, 7 pages.

*Primary Examiner* — Chuck Y Mah
(74) *Attorney, Agent, or Firm* — Masuvalley & Partners

(57) ABSTRACT

A stay includes a first arm rotatably connected to any one of a body or a door openable to the body; a second arm, one end of the second arm being rotatably connected to the first arm and the other end being connected to any one of the body or the door. The first arm includes a resilient body, a slider urged by the resilient body to the second arm. A case slidably supports the slider toward the second arm, and a pressing part is abutted and pressured onto a cam face disposed to the second arm by the slider. An adjustment mechanism changes a pressing position between the cam face and the pressing part to a crossing direction with respect to a sliding direction of the slider and a rotation shaft axis direction of the second arm.

3 Claims, 14 Drawing Sheets

(58) Field of Classification Search
CPC ... Y10T 16/5448; Y10T 16/5383; H04N 1/00; H04N 1/00543; H04N 1/00554; H04N 1/00519; H04N 2201/0422; E05Y 2900/608; E05Y 2900/606; E05Y 2900/60; E05Y 2201/212; G03G 15/605; G03B 27/62; G03B 27/6228; E05D 3/18; E05D 3/20; E05D 3/02; E05D 7/04; E05D 7/12; E05D 11/1064; E05D 11/00; E05D 11/06; E05F 1/14; E05F 1/1246; E05F 1/1253; E05F 1/1261; E05C 17/32; E05C 17/34
See application file for complete search history.

(56) References Cited

U.S. PATENT DOCUMENTS 3,947,918 A * 4/1976 Favre ..... E05F 1/105 16/72
4,660,251 A * 4/1987 Watabe ..... E05D 7/04 16/289
4,773,125 A * 9/1988 Watabe ..... E05F 3/104 16/53
6,530,122 B1 * 3/2003 Kondou ..... E05D 11/1064 16/257
6,684,456 B2 * 2/2004 Lee ..... E05D 11/1064 16/342
8,894,162 B2 * 11/2014 Kashiwaguma ..... E05F 1/1058 312/319.2
2004/0045129 A1 * 3/2004 Tamehira ..... G03G 15/605 16/223
2004/0218229 A1 * 11/2004 Choi ..... H04N 1/00559 358/474
2007/0251056 A1 * 11/2007 Aoyagi ..... H04N 1/00519 16/221
2015/0067986 A1 * 3/2015 Lee ..... H04N 1/00519 16/321
2015/0351539 A1 * 12/2015 Baldreich ..... A47B 97/00 312/319.2
2018/0347247 A1 * 12/2018 Kondo ..... E05D 11/1064
2018/0363349 A1 * 12/2018 Kuramochi ..... E05F 3/16

* cited by examiner

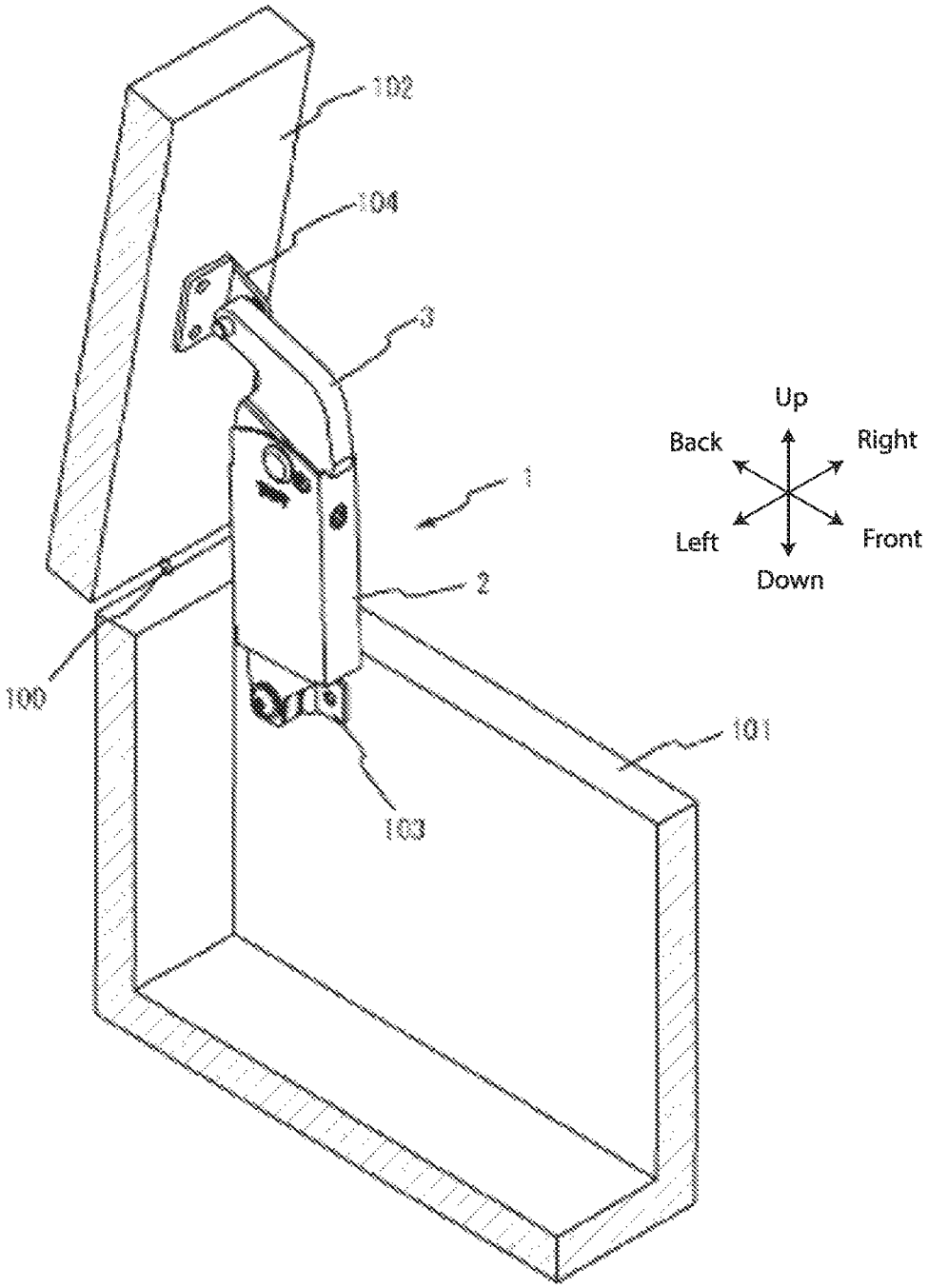
[FIG.1]

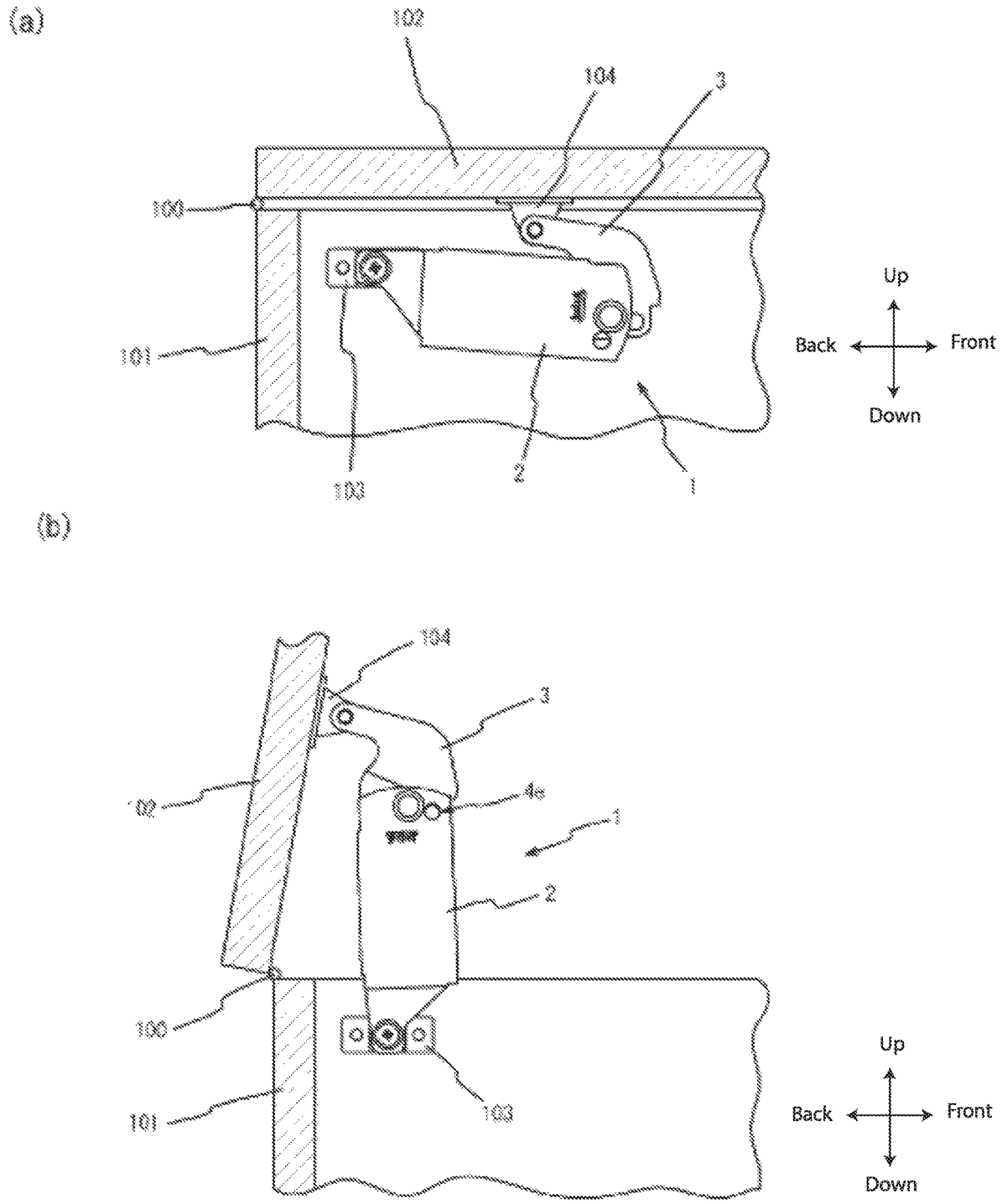
[FIG.2]

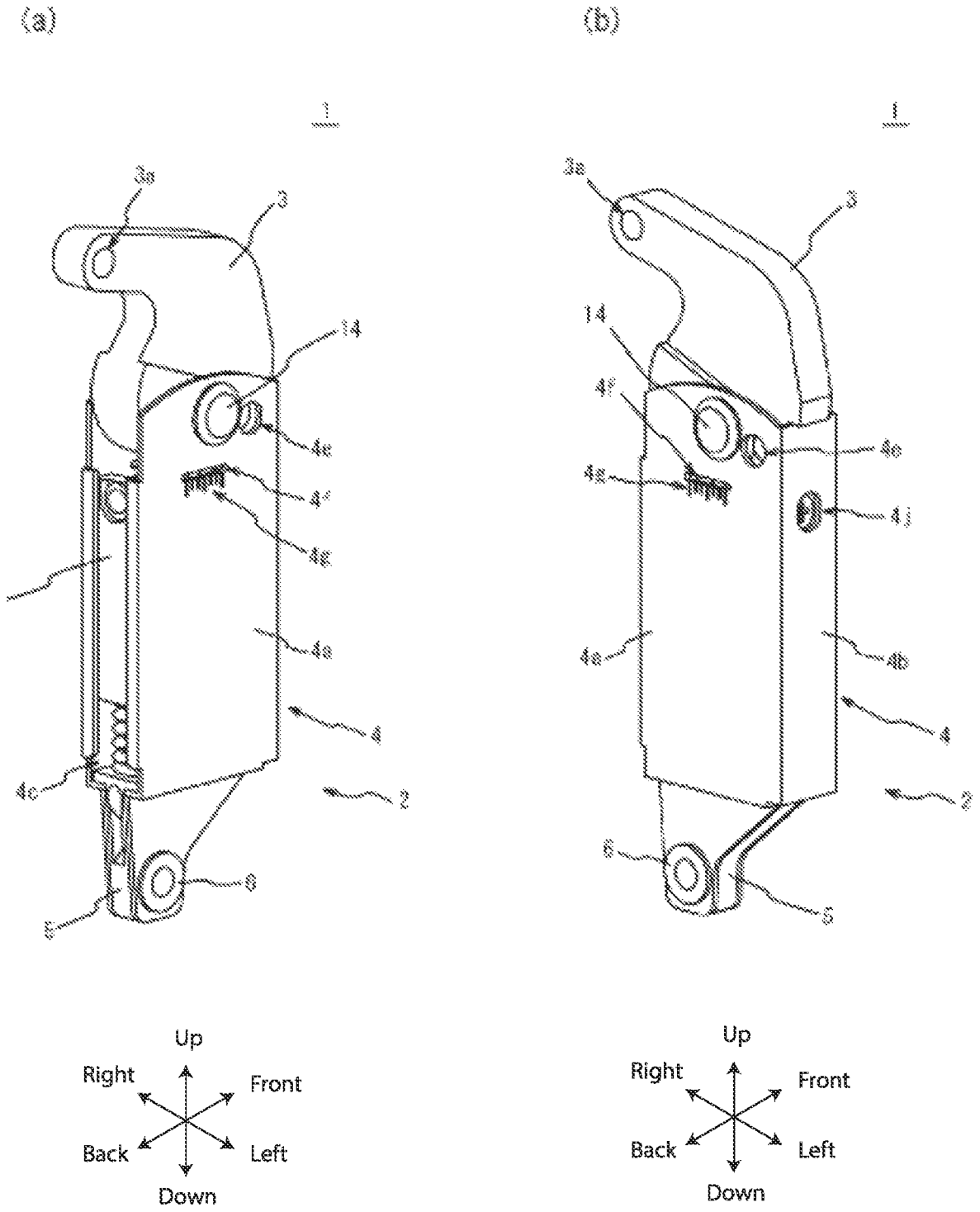
[FIG.3]

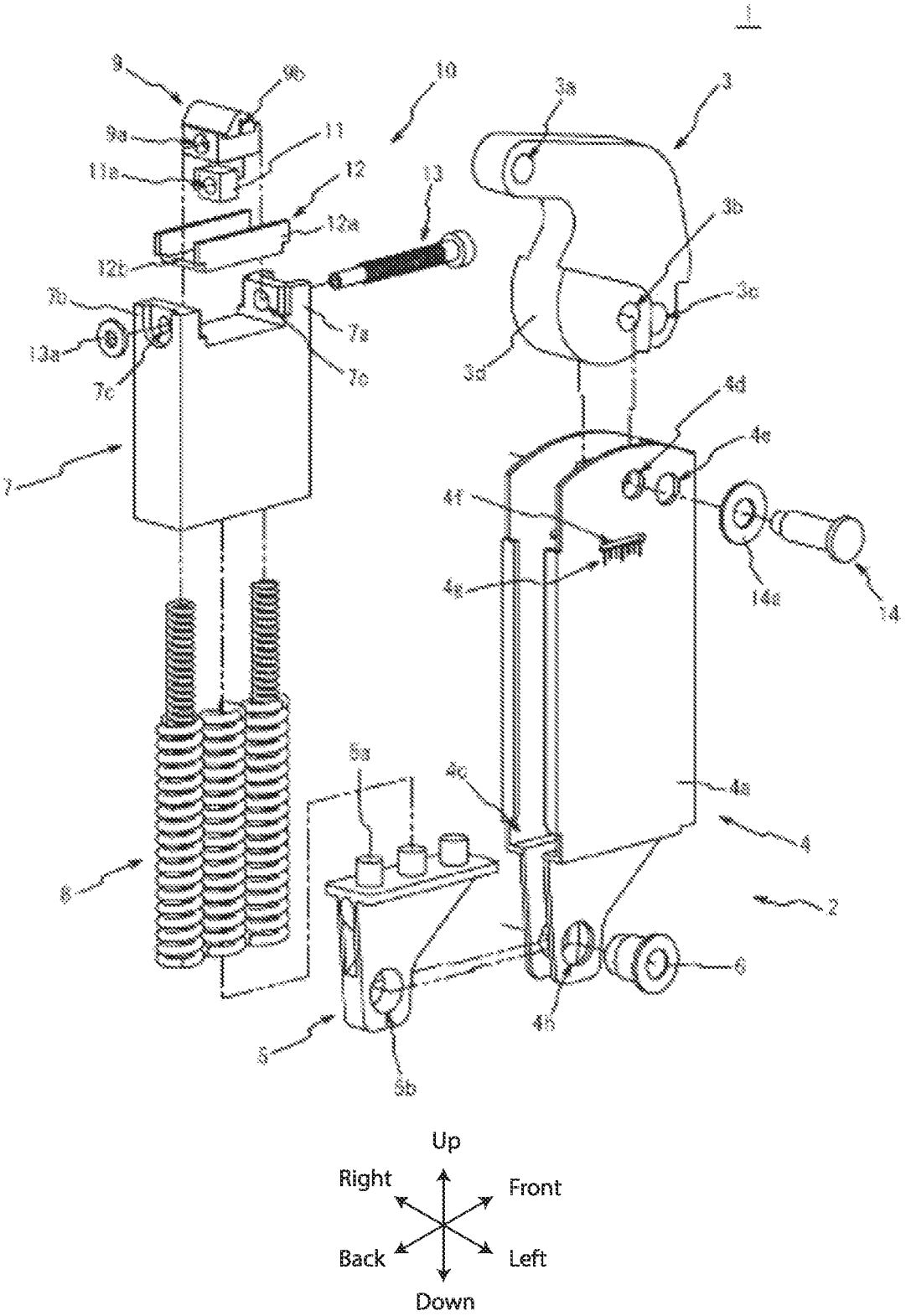
[FIG.4]

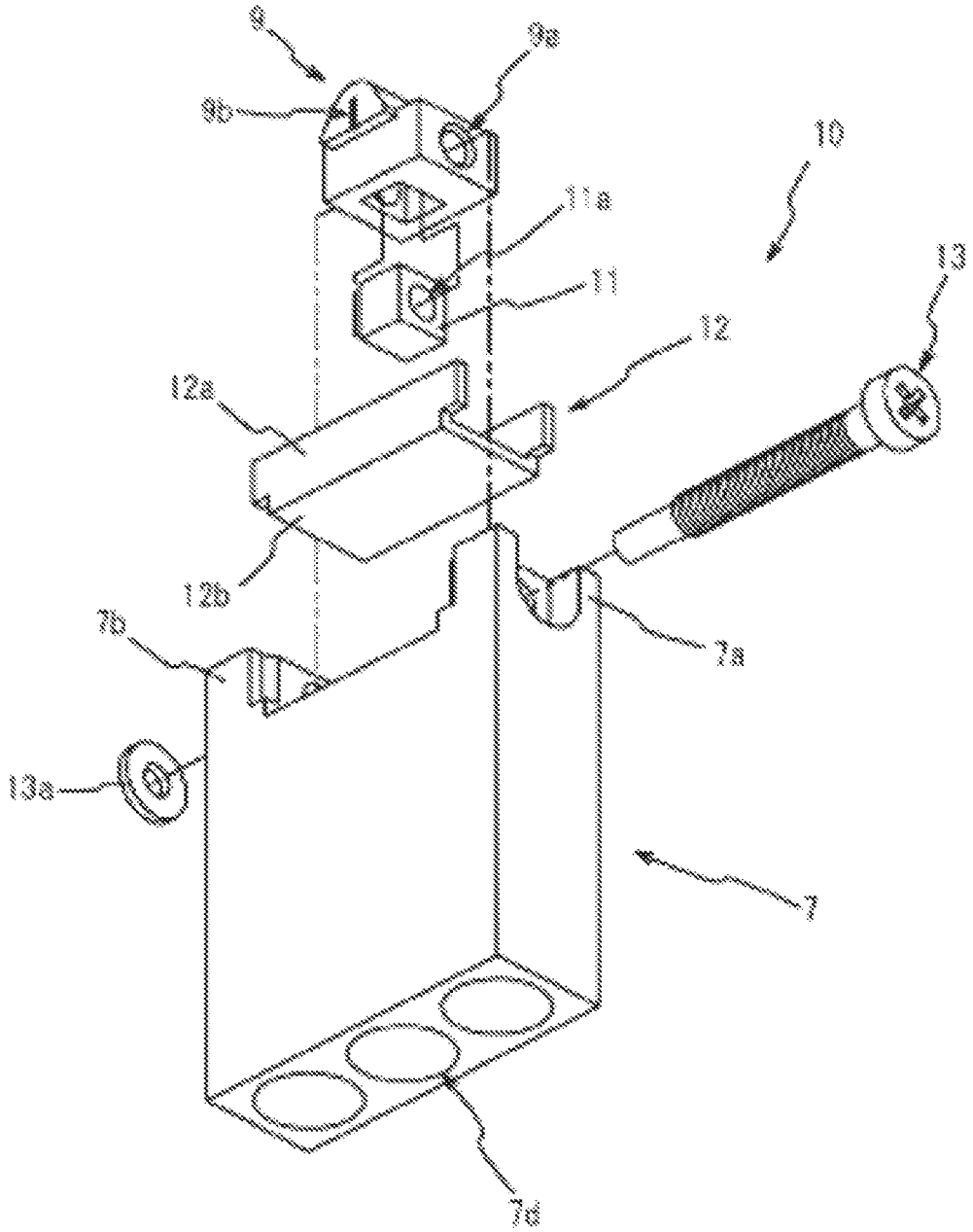
[FIG.5]

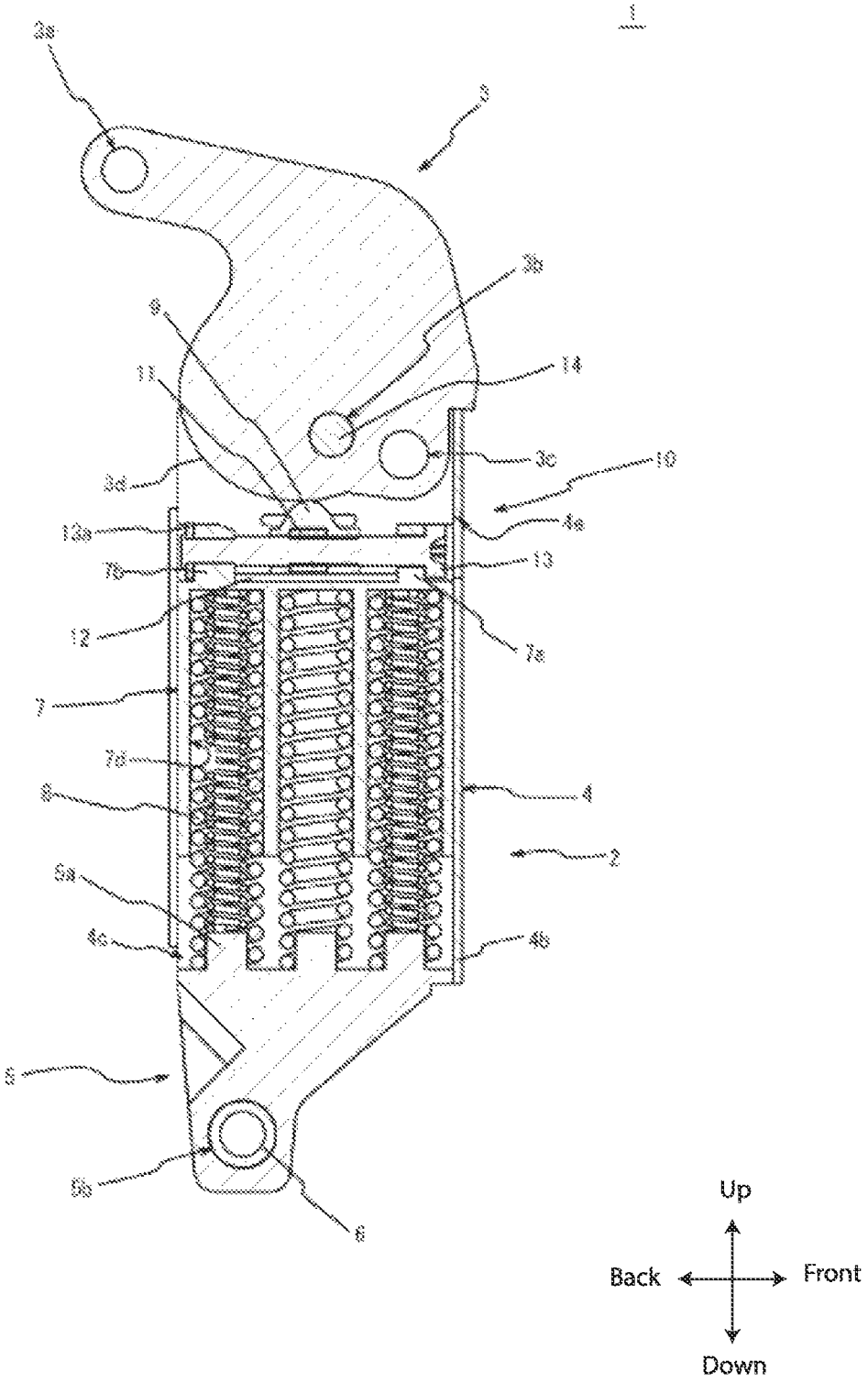
[FIG.6]

(a)
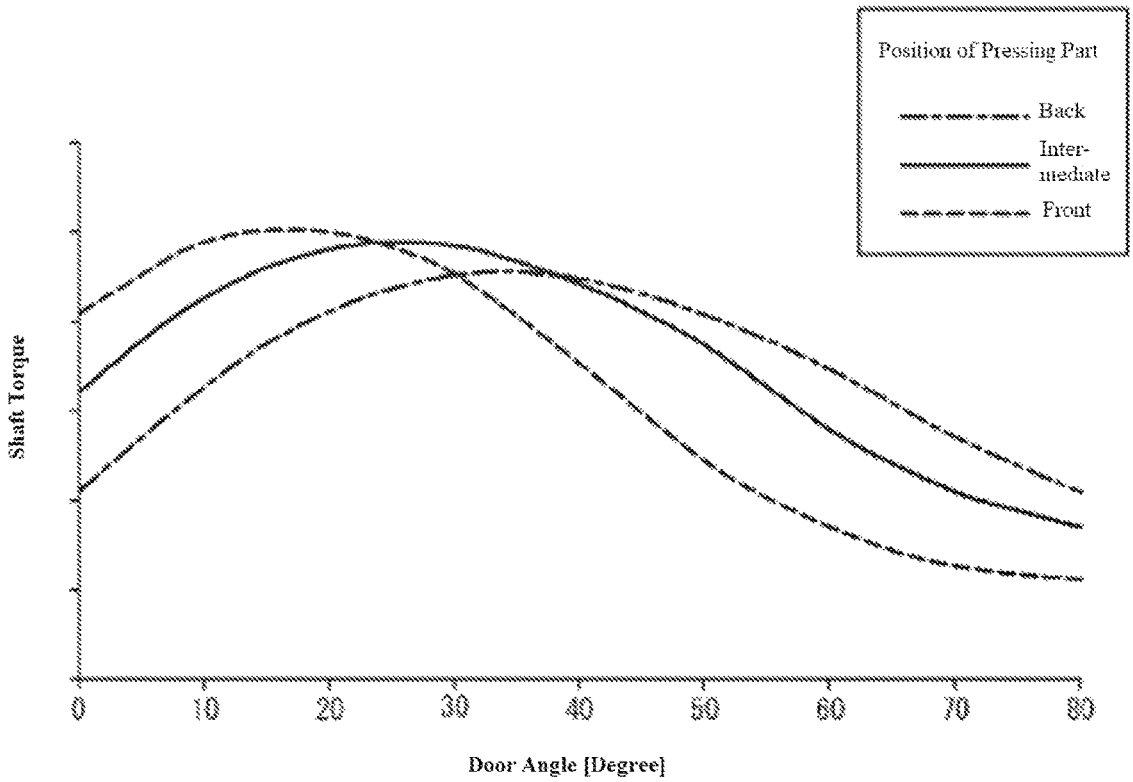
(b)
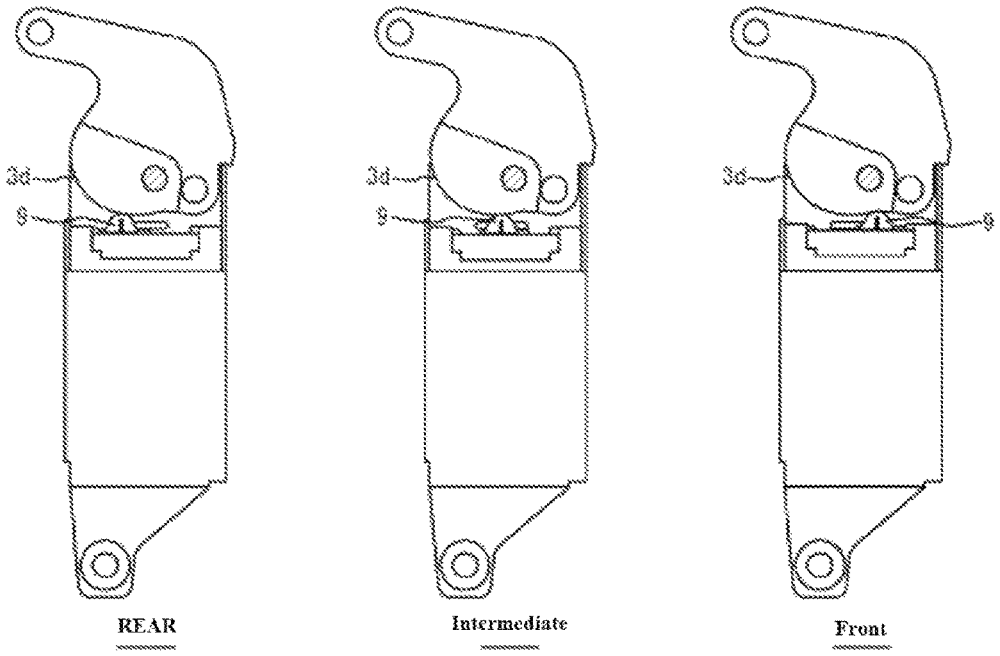
[FIG.7]

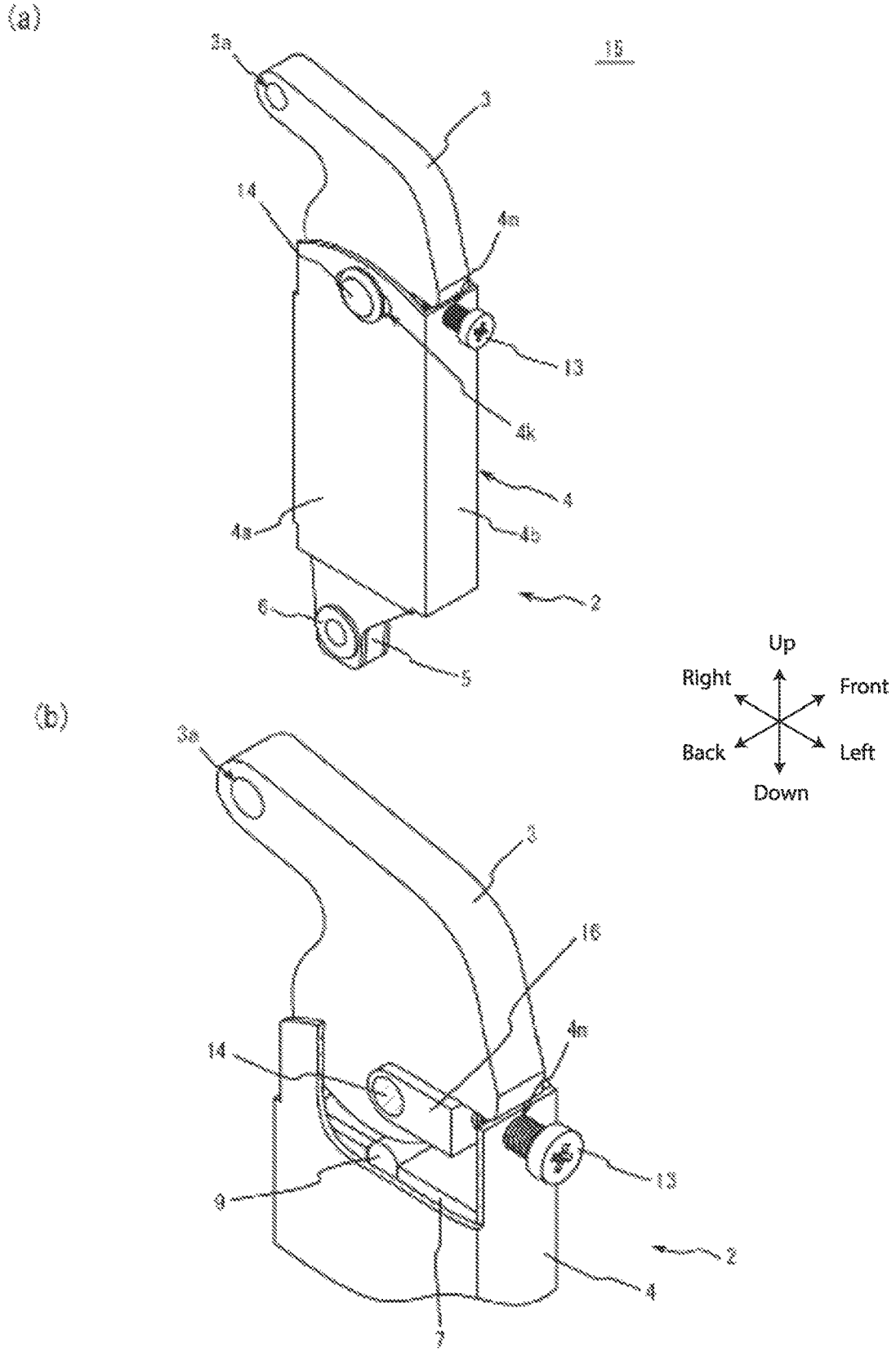
[FIG.8]

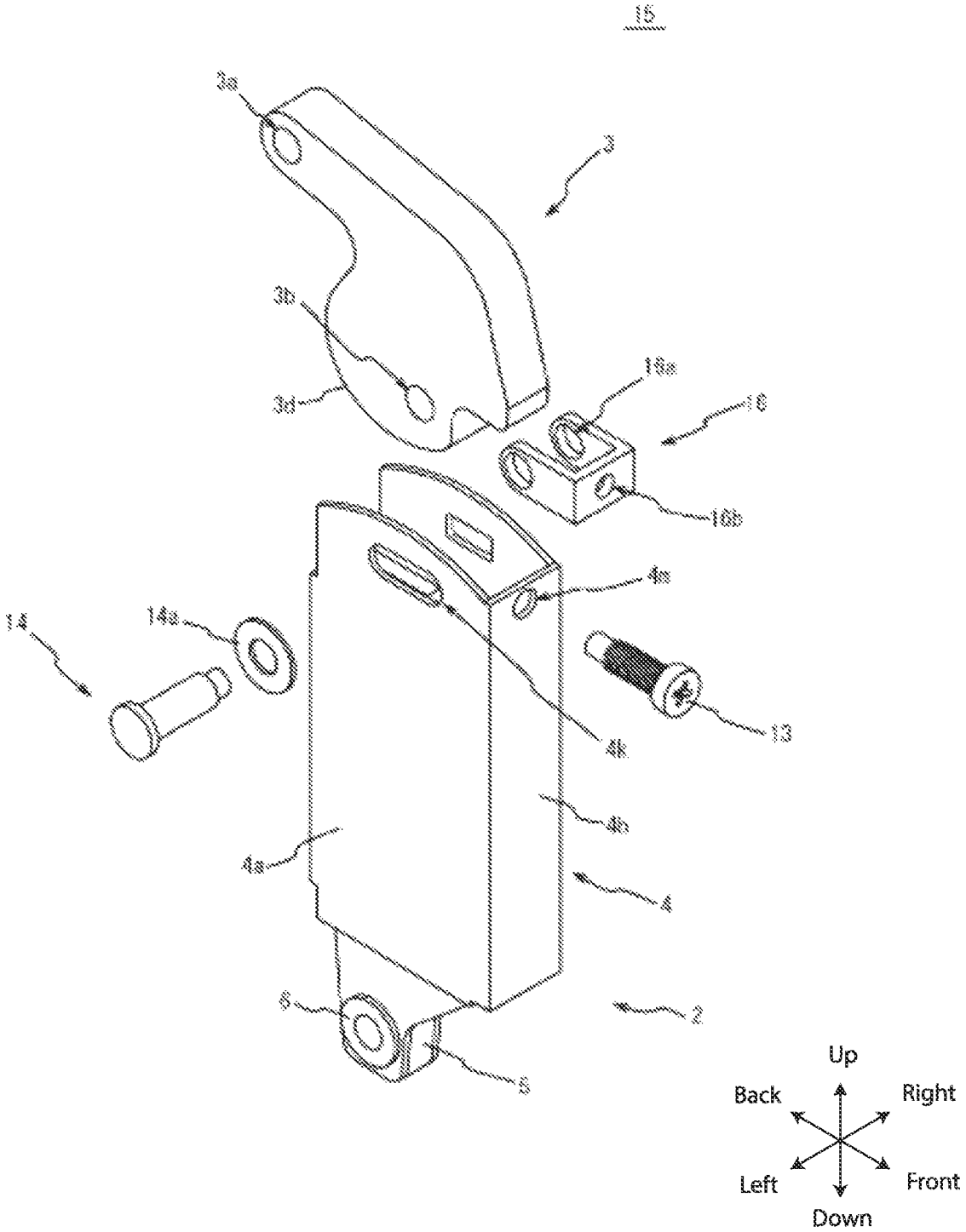
[FIG.9]

(a)
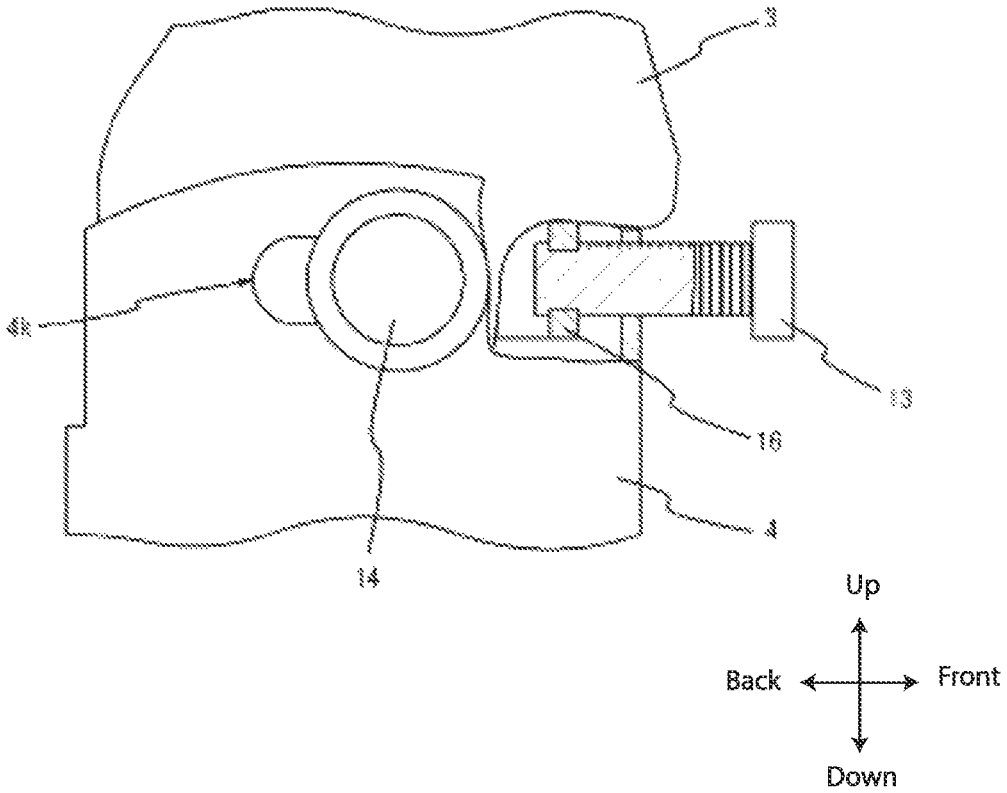
(b)
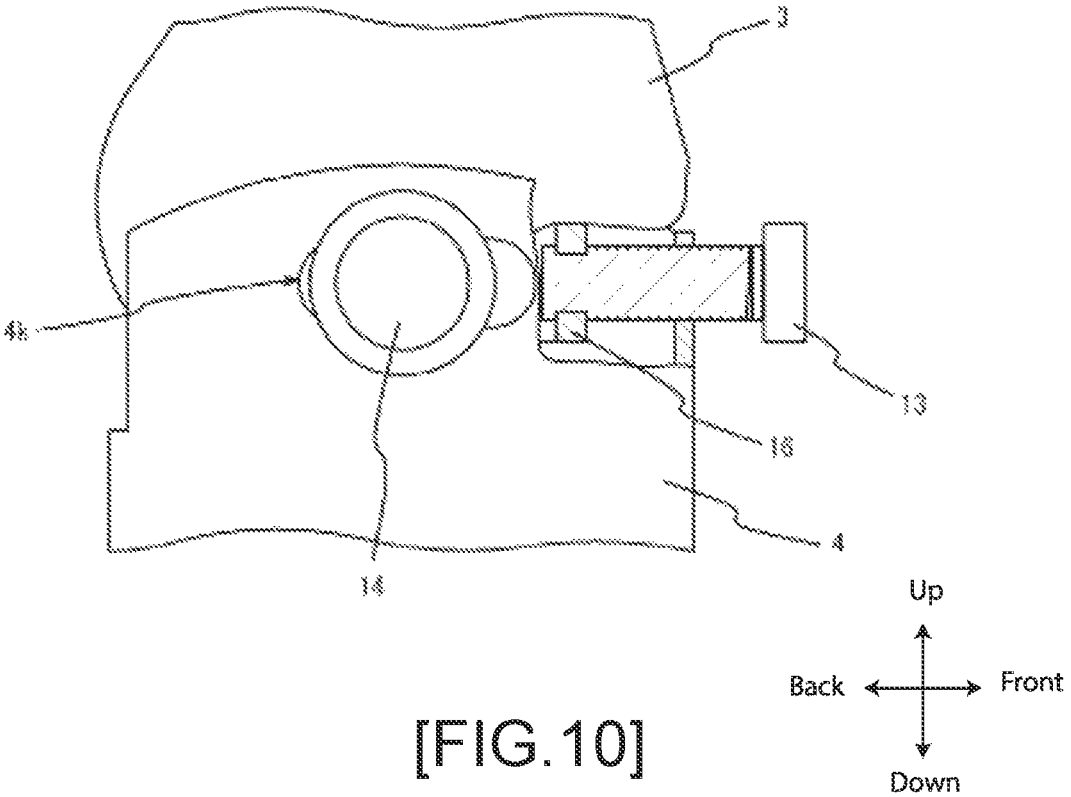
[FIG.10]

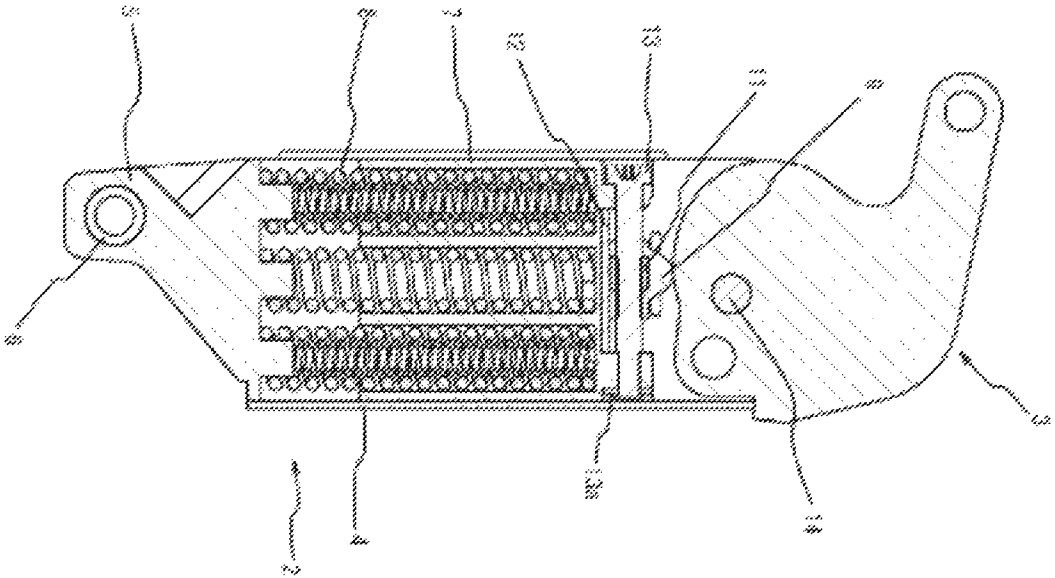
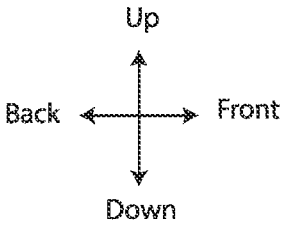
[FIG.11]

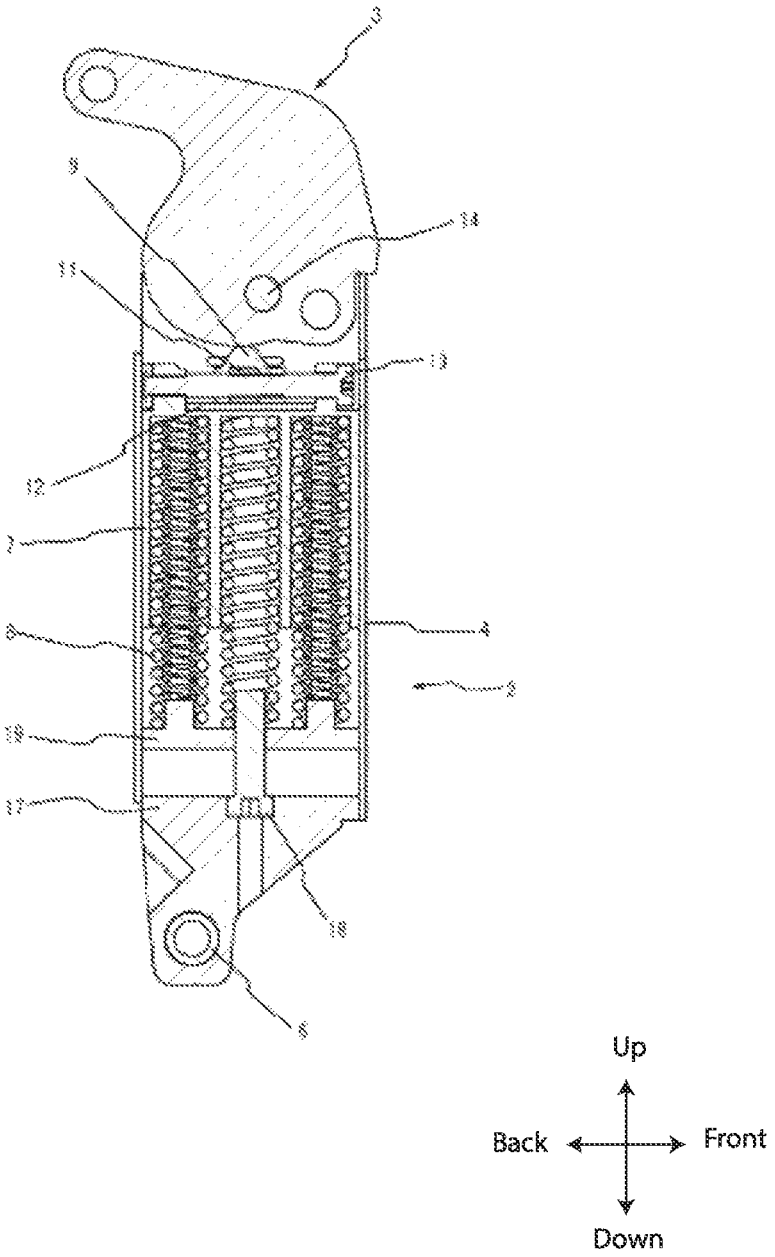
[FIG.12]

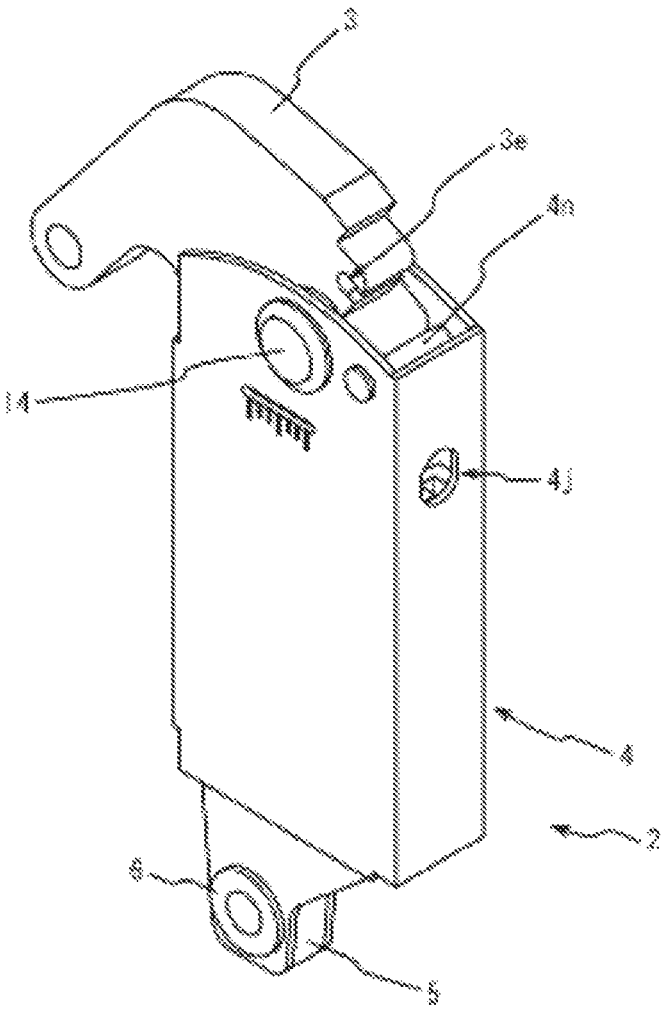
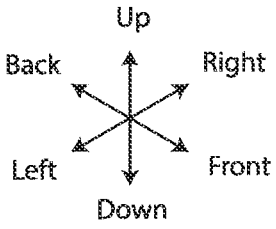
[FIG.13]

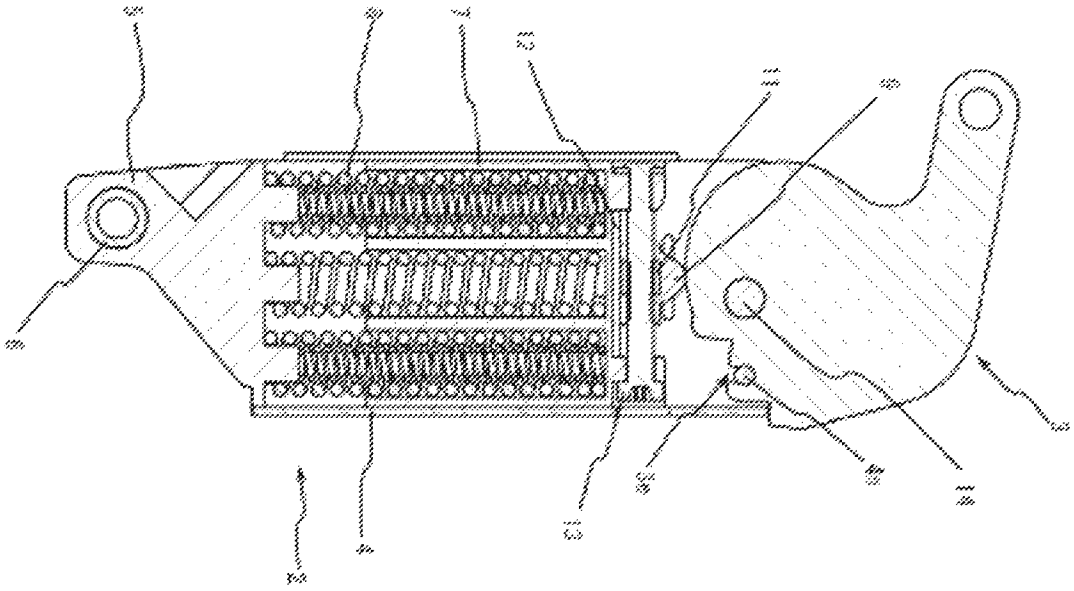
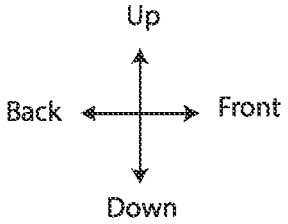
[FIG.14]

STAY

RELATED APPLICATIONS

This application is the U.S. National Phase of and claims priority to International Patent Application No. PCT/JP2019/019419, International Filing Date May 16, 2019; which claims priority to Japanese Patent Application No. JP2018-125467 filed Jun. 29, 2018; both of which are incorporated herein by reference in their entireties.

FIELD OF INVENTION

The present invention relates to a stay including a first arm and a second arm rotatably connected each other and being attached between a body and a door.

BACKGROUND

As one that assists to open a door by a user and keeps a position of an opened door, a stay has been known. The stay includes a first arm and a second arm rotatably connected each other, and for example, the first arm is connected rotatably to a body and the second arm is connected rotatably to a door. To the first arm, a resilient body such as a spring and so on is disposed to exert assisting power against the door. Thus, the assisting power of the resilient body is converted to torque along a direction of opening of the second arm by, for example, a cam, and lastly, the assisting power is exerted to the door in the opening direction.

In Patent Literature 1, a stay including an adjustment mechanism, which can adjust such assisting power, is disclosed. The adjustment mechanism disclosed in the same literature is disposed with a spring between an engagement piece abutting to the cam and a receiver member, and makes it possible to adjust a position of the receiver member to the engagement piece along a longitudinal direction of a spring. That is to say, this adjustment mechanism, by changing the spacing between the receiver piece and the receiver member, changes the assisting power acting to the cam to adjust the assisting power by changing the magnitude of torque to be converted.

PRIOR ART LITERATURE

Patent Literature

PATENT LITERATURE 1: Japanese Patent (Laid-open) No. 2015-209755

SUMMARY OF INVENTION

Problem to be Solved by Invention

Incidentally, the adjustment mechanism disclosed in Patent Literature 1, when increasing resilient force generated by a spring by narrowing the spacing between a engagement piece and a receiver member, converted torque constantly increased from opening position to closing position of a door. That is to say, this adjustment mechanism can change widely the magnitude of assisting power, however, the adjustment mechanism has not been able to adjust relation between an angle of the door and the assisting power, for example, as the assisting power when the door starts to open is suppressed while obtaining larger assisting power after the door being opened to some extent.

In order to address such problem, the present invention aims to provide the stay which can adjust assisting power more variously when compared to the stay having the conventional adjustment mechanism.

Means for Solving Problem

A stay of the present invention comprises: a first arm rotatably connected to any one of a body or a door openable to the body; a second arm, one end of the second arm being rotatably connected to the first arm and the other end being connected to any one of the body or the door; the first arm including a resilient body, a slider urged by the resilient body to the second arm, a case supporting slidably the slider toward the second arm, and an pressing part being abutted and pressured onto a cam face disposed to the second arm by the slider; and an adjustment mechanism changing a pressing position between the cam face and the pressing part to a crossing direction with respect to a sliding direction of the slider and a rotation shaft axis direction of the second arm.

In such stay, the adjustment mechanism may include an adjustment screw being screwed to any one of the pressing part or the slider while being supported rotatably by the any other one, and making the pressing part and the slider move relatively.

In addition and in such stay, the pressing part preferably includes an anti-loosing member abutting to the adjustment screw.

In addition and in such stay, the adjustment mechanism preferably includes a receiver member being placed between the slider and the pressing part while supporting the pressing part slidably, and being disposed at an opposite side to a side imparted with urging force of the resilient body to receive the urging force of the resilient body.

Furthermore, in such stay, the adjustment mechanism preferably include an adjustment screw being screwed to any one of the case and the second arm while supported rotatably by the other one, and making the case and the second arm move relatively.

And in such stay, the pressing part preferably makes the second arm exert torque in a direction for opening the door throughout the entire region of the pressing position being changed by the adjustment mechanism.

Advantageous Effect of Invention

In a stay of the present invention, by using an adjusting mechanism that can change the abutting position between a cam face and a pressing part to a crossing direction with respect to a slide-direction of a slider and also to a direction of the rotation shaft line of a second arm, the relation between an angle of the second arm and the torque converted from abutting power of a resilient body can be changed such that the assisting power can be adjusted more variously when compared to the conventional adjustment mechanism.

BRIEF DESCRIPTION OF DRAWINGS

FIG. 1 A perspective view of a stay of a first embodiment of the present invention under the condition attached to a body and a door.

FIG. 2 For the stay shown in FIG. 1, FIG. 2 (*a*) shows a side view at the condition where the door is closed, and FIG. 2 (*b*) shows a side view at the condition where the door is opened.

FIG. 3 For the stay shown in FIG. 1, FIG. 3 (*a*) shows a perspective view from the back side, and FIG. 3 (*b*) shows a perspective view from the front side.

FIG. 4 An exploded perspective view of the stay shown in FIG. 1.

FIG. 5 An exploded perspective view around an adjustment mechanism viewed from a different viewpoint.

FIG. 6 A cross sectional view of the stay shown in FIG. 1.

FIG. 7 For the stay shown in FIG. 1, FIG. 7 (*a*) is a graph illustrating the relation between a door angle and a shaft torque with changing positions of a pressing part, and FIG. 7 (*b*) is a drawing explaining the position of the pressing part.

FIG. 8 With respect to a second embodiment of a stay of the present invention, FIG. 8 (*a*) is a perspective view and FIG. 8 (*b*) is a perspective view partially illustrating an inside structure.

FIG. 9 An exploded perspective view of the stay shown in FIG. 8.

FIG. 10 For the stay shown in FIG. 8, a side view partially illustrating an inside structure, and FIG. 10 (*a*) shows the condition where the stay is moved anteriorly a second arm with respect to a first arm, and FIG. 10 (*b*) shows the condition where the stay is moved posteriorly a second arm with respect to a first arm.

FIG. 11 A cross section of a first modification of the stay shown in FIG. 1 as a side view.

FIG. 12 A cross section of a second modification of the stay shown in FIG. 1 as a side view.

FIG. 13 A cross section of a third modification of the stay shown in FIG. 1 as a side view.

FIG. 14 For the stay show in FIG. 13, a cross section under the condition where a fuck and a pin are engaged.

EMBODIMENT FOR PRACTICING INVENTION

Hereinbelow, one embodiment of a stay according to the present invention will be described with referring to attached drawings. Now, the say of the present invention should not be limited to embodiments disclosed in this description and the drawings and can include various embodiments practiced within the scope in accordance with Claims.

FIG. 1-FIG. 7 depict a stay 1 of a first embodiment of the present invention. First, with referring to FIG. 1 and FIG. 2, explanation will be provided about the situation where the stay 1 of the present embodiment is used. As shown in FIG. 1, the stay 1 has an opening part at its upper side, and is used by being attached between a body 101 having a hinge 100 disposed at the back and the top thereof and a door 102 disposed openably to the body 101 through a hinge 100. Now, in the present description and so on, as for convenience sake, the description will be presented in the direction when viewed the stay 1 at the condition where the door 102 is opened from the front (up-and-down, right-and-left, and forward-and back directions) as shown in FIG. 1.

The stay 1 includes a first arm 2 and a second arm 3 rotatably connected each other. The first arm 2 is attached rotatably to the body 101 through a clip plate 103, and the second arm 3 is attached rotatably to the door 102 through a clip plate 104 as a connection element.

When the stay 1 is used as FIG. 1, the door 102, rotates in the range from the closed state to the body 101 (an opening angle of the door is to be about 0 degree) as shown in FIG. 2 (*a*) to the opened state being opened largely above to the body 101 as shown in FIG. 2 (*b*) (the opening angle of the door is to be about 80 degrees). In addition, when the door 102 is opened and closed as illustrated, the stay 1 provides an assisting function for making a user easy to bring up the door 102 and a free-stop function for keeping the brought-up door 102 at an optional opening angle. This embodiment is configured so as to present the assisting function and the free-stop function in the range of door-open angle between about 10 degrees and 80 degrees.

Here, the clip plate 103 shown is attached to an inside lateral face of the body 101, however, the clip plate attached to an inside back face of the body 101 may be used. Besides, the stay 1 can be attached to the one other than the system where the door 102 opens to the back from this side as illustrated, and for example, the stay 1 can be attached between the body having an opening part at the front and having a hinge at upper part of the front side and the door is disposed in front of the body through the hinge for allowing the opening from a lower side to a upper side.

Next, the configuration of stay 1 will be described in detail with referring to FIG. 3-FIG. 6. The first arm 2 described above includes, as shown in FIG. 4, a case 4 having a cylindrical shape, a spring receiver 5 fixed to an bottom end of the case 4, a bushing 6 inserted into the case 4 and also into the spring receiver 5, a slider 7 received slidably up and down to the case 4, a resilient body lying between the spring receiver 5 and the slider 7 (in this embodiment, a metal spring 8 coiled spirally), and a pressing part 9 disposed at an upper pert of the slider 7. Besides, between the slider 7 and the pressing part 9, an adjustment mechanism 10, which is configured for making the pressing part 9 move front and back to the slider 7, is disposed. The adjustment mechanism 10 includes an anti-loosing member 11 held with the pressing part 9, a receiver member 12 supporting slidably the pressing part 9, an adjustment screw 13 being screwed to the pressing part 9, and the slider 7 supporting rotatably the adjustment screw 13. Furthermore, the first arm 2 and the second arm 3 are connected rotatably by a shaft part 14.

The case 4 is formed by folding a metal thin plate to the shape including a right-and-left pair of lateral plates 4*a*, and a front plate 4*b* connecting the lateral plates 4*a* at the front while its back being opened. Now, the opened back-side part of the case 4 will be referred to a back opening 4*c*. The lateral plates 4*a* of the present embodiment is formed so as to have an upper quadrilateral shape and a lower triangle shape and the spacing between the lateral plates 4*a* becomes narrow such that the spacing of the bottom part is narrower than that of the upper part. In addition, at the upper part of the lateral plates 4*a*, shaft holes 4*d* positioned near the center of front and back direction, upper through-holes 4*e* positioned in front of the shaft hole 4*d*, a window hole 4*f* being placed below the shaft hole 4*d* while extending along the front and back direction, and a measure 4*g* positioned below the window hole 4*f* are disposed. At the lower part of the lateral plates 4*a*, lower through-holes 4*h* are disposed. Furthermore, as shown in FIG. 3, at the upper side of the front plate 4*b*, a hole 4*j* for adjustment is disposed.

The spring receiver 5 forms generally a shape connecting the plate pieces each having a rectangular shape in their planer view and the plate pieces each having a triangle shape in its side view, and the spring receiver 5 is made of a synthetic resin. At the upper part of the spring receiver 5, protrusions 5*a* each having a columnar shape for positioning the spring 8 are disposed. At the bottom part of the spring receiver 5, a bottom through-hole 5*b* is disposed. The spring receiver 5 is inserted from the back opening 4*c* to be held by the case 4.

The bushing 6 has the shape that forms generally a cylinder shape and is disposed with a flange at one end along an axis direction. In addition, in the condition where the spring receiver 5 is held in the case 4, the bushing 6 is inserted and is held in the bottom through-holes 4*h*, 5*b*. The bushing 6 is inserted with a screw and the like as shown in FIG. 1 and has a function for holding the first arm 2 rotatably with respect to the clip plate 103.

The slider 7 has the shape that a front wall 7*a* and a back wall 7*b* are disposed with the spacing along the front and back direction at the upper part of the part having a rectangular shape in its lateral view, and is made of a synthetic resin. To the front wall 7*a* and the back wall 7*b*, circular through-holes 7*c* extending along the front and back direction are disposed for supporting rotatably the adjusting screw 13. Besides, as shown in FIG. 5, the slider 7 has a concave part 7*d* for receiving the spring 8. The slider 7 formed to such shape is placed slidably to the up and down direction in the case 4.

The springs 8 are lain between the spring receiver 5 and the slider 7 to urge the slider 7 upwardly. The springs 8 of the present embodiment are positioned by the protrusion 5*a* and the concave part 7*d*. Furthermore, the springs 8 with three larger diameter types and two smaller diameter types are used in the illustrated embodiment, however, the number and sizes may be adequately selected.

The pressing part 9 has the shape connecting the upper part having almost the triangular shape and the lower part having the quadrilateral shape in its lateral view and is made of metal. The width of right and left direction of the pressing part 9 becomes wider at the upper part having the triangular shape than the lower part having the quadrilateral shape. Besides, at the lower part of the pressing part 9, a female screw part 9*a* extending to the front and back direction is disposed. As shown in FIG. 5, the lower part of the pressing part 9 is disposed with a concave part for receiving the anti-loosing member 11. Furthermore, the upper lateral side of the pressing part 9 is disposed with a position indicating part 9*b* being seen visually through the window hole 4*f* when the pressing part 9 is assembled.

The anti-loosing member 11 has generally a rectangular solid shape and is made of a synthetic resin. At the center of the anti-loosing member 11, a circular through-hole 11 extending to the front and back direction is formed at the position aligned to the female screw part 9*a* when assembled to the pressing part 9. Here, the through-hole 11*a* is formed as providing an outer diameter of an extent allowing an outer face of the adjustment screw 13 to abut.

The receiver member 12 is formed by folding a thin metal plate and has a right-and-left pair of lateral plates 12*a* and a bottom plate 12*b* connecting the lateral plates 12*a* each other at the lower side. The receiver member 12 is attached at the upper part of the slider 7 between the front wall 7*a* and the back wall 7*b*. Here, the receiver member 12 supports slidably the triangular shape part of the pressing part 9 by the top part of the lateral plates 12*a*. Furthermore, the receiver member 12 has the function for enforcing the slider 7 by receiving the urging force of the springs 8 acting from the lower direction of the slider 7 with making the lower plate 12*b* abut to the upper face of the slider 7. That is to say, as shown in FIG. 6, the upper part of the slider 7 becomes thin by the concave parts 7*d* for each receiving the springs 8 and can resist the urging force of the spring 8 by the metal receiver member 12 such that deformation of the thin part can be protected. Now, spacing may be left between the lower face of the pressing part 9 and the upper face of the lower plate 12*b*, however, the deformation of the thin part can be more effectively protected by making the lower face of the pressing part 9 contact with the upper face of the lower plate 12*b*.

The adjustment screw 13 is held rotatably to the slider 7 under the condition where the pressing part 9, the anti-loosing member 11, and the receiver member 12 are fixed to the slider 7. Particularly, one end of the adjustment screw 13 and the opposite end are supported rotatably by through-holes 7*c* of the front wall 7*a* and the back wall 7*b*, and the male screw part disposed at the center of the adjustment screw 13 is screwed into the female part 9*a* of the pressing part 9. Thus, by the rotation of the adjustment screw 13, the pressing part 9 is made to move in the front and back direction with respect to the slider 7. Also, in this condition, the male screw part of the adjustment screw 13 abuts to the through-hole 11*a* of the anti-loosing member 11. That is to say, the adjustment screw 13 does not rotate carelessly so that the pressing part 9 can not move carelessly. Here, when attaching the adjustment screw 13 to the slider 7, a washer 13*a* shown in FIG. 4 is used and after inserting the adjustment screw 13 into the washer 13*a*, the end inserted therethrough is crimped and so on to prevent from escape.

Furthermore, the second arm 3 has generally an L-shape in its plane view and is made of a synthetic resin. At the upper part of the second arm 3, an upper through-hole 3*a* is disposed. Into the upper through-hole 3*a*, a pin and so on is inserted as shown in FIG. 1 to provide the function that the second arm 3 is held rotatably to the clip plate 104. In addition, at the lower part of the second arm 3, a shaft hole 3*b* is disposed at the center along the front and back direction as shown in FIG. 4, and at the front of the shaft hole 3*b*, a through-hole 3*c* is disposed. Besides, at a lower edge part of the second arm 3, a cam face 3*d* to which the pressing part 9 abuts, is disposed.

The shaft part 14 has generally a columnar shape in which a flange is disposed at one end along the shaft direction. The shaft 14 is inserted into the shaft hole 4*d* of the case 4 and the shaft hole 3*b* of the second arm 3 to connect rotatably the first arm 2 and the second arm 3. Now, when attaching the shaft part 14, a washer 14*a* shown in FIG. 4 may be used.

In the stay 1 as such configured and shown in FIG. 6, the slider 7 is urged upwardly by the springs 8 to make the pressing part 9 abut onto the cam face 3*d*, thereby the torque acts to the second arm 3. According to the present embodiment, by rotating the adjustment screw 13, the pressing part 9 can be moved along the front and back direction with respect to the slider 7. Therefore, by moving the pressing position where the pressing part 9 pressingly abuts onto the cam face 3*d* (by changing the pressing position between the pressing part 9 and the cam face 3*d* to both of the direction almost crossing at right angle to the slide direction of the slider 7 and the rotation shaft axis direction to the slider 7) to change the torque acting to the slider 7. Besides, according to this embodiment, the position of the pressing part 9 to the slider 7 can be checked by the measure 4*g* disposed to the case 4 and the position indicating part 9*b* viewed through the window hole 4*f*. Thus, the adjustment of torque acting to the second arm 3 can be done with good reproducibility and accuracy.

FIG. 7 (*a*) shows a graph presenting one example of the relation between the angle of the door 102 and the shaft torque about the shaft part 14 (a shaft torque to the direction for opening the door 102) under the condition where the stay 1 is attached to the body 101 and the door 102. The one-dot-chain line in the graph of FIG. 7 (*a*) shows the relation between the angle and the shaft torque under the condition where the pressing part 9 is moved the most posteriorly in the movable range of the pressing part 9. In addition, with respect to this relation between the angle and the shaft torque, the dashed line in the graph of FIG. 7 (*a*) shows the condition where the pressing part 9 is moved the most anteriorly as shown in FIG. 7 (*b*), and the solid line shows the condition where the pressing part 9 is moved to the center position. In such stay 1, by rotating the adjustment screw 13 and by moving posteriorly the pressing part 9 from the center position, as shown as the solid line and the one-dot-chain line of the graph of FIG. 7 (*a*), the shaft torque about the shaft part 14 becomes small when compared to that in the center position under the condition where the angle of the door 102 is small, however, when the angle becomes larger to some extent, larger shaft torque can be obtained. That is to say, by adjusting as described above, while suppressing assist force at the starting stage during door opening, the larger assist force can be provided to the door 102 after the door is opened to some extent. On the other hand, when the pressing part 9 is moved anteriorly from the center position, as shown as the solid line and the dashed line in the graph of FIG. 7 (*a*), though the shaft torque becomes smaller at the stage where the angle of the door becomes larger to some extent, the larger shaft torque can be obtained at the smaller angle of the door 102. Thus, the case adjusted as above can make the assist force larger at the stage when the door 102 becomes open.

Now, depending on shapes and positional relations of the cam surface 3*d*, the pressing part 9 and the shaft part 14, the torque directing to the closing direction of the door 102 (the direction that the door 102 is returned to the body 101) can be also made to act. With configuring as describe above, for example by applying the door that opens to the horizontal direction with respect to the body, the door can be securely closed. On the other hand, as the present embodiment, when attached to one that the door 102 opens upwardly to the body 101, as shown in FIG. 2 (*a*), by using the stay 1 that the torque toward the direction for opening the door 102 acts to the second arm 3 within the entire region of the movable range of the pressing part 9, the assisting function and the free-stop function can be obtained almost in the entire movable region of the door 102.

Incidentally, in the condition where the door 102 is opened largely and upwardly as shown in FIG. 2 (*b*), the through-hole 3*c* of the second arm 3 (refer to FIG. 4) comes to the position aligned to the upper through-hole 4*e* of the case 4. Therefore, in the case where the stay 1 is attached to the body 101 and the door 102 and so on, a stick-like shaped tool, for example, such as a driver is inserted into the through-hole 3*c* and the upper through-hole 4*e*, the second arm 3 can not rotate such that the shortcoming of uncareful closing of the door 102 can be prevented.

Although the stay 1 of the above first embodiment has been one that adjust the assist force provided to the door 102 by moving the pressing part 9 with respect to the slider 7 along the front and back direction, the similar effect can also obtained by using a stay 15 of the second embodiment.

FIG. 8-FIG. 10 shows the stay 15 of the second embodiment. The stay 15 is generally one that the slider 7 and the pressing part 9 are connected integrally; the second arm 3 includes a bracket 16, and further the adjustment screw 13 is screwed to the case 4 while supported rotatably by the bracket 16. Now, in the description below, parts having common functions with the first embodiment will be indicated by the same numerals and the explanation will be omitted.

The case 4 of this embodiment includes, as shown in FIG. 9, a long hole 4*k* extending along the front and back direction at the upper part of the lateral plate 4*a*. Besides, at the upper part of the front plate 4*b*, a screw hole 4*m* adapted to be screwed with the adjustment screw 13 is disposed.

The bracket 16 has generally a channel shape in its plane view. At the right and left sides of the bracket 16, the through-holes 16*a* are disposed. Furthermore, to the forward side of the bracket 16, one end part of the adjustment screw 13 is inserted and a supporting hole 16*b* for supporting rotatably it is disposed.

Besides, the shaft part 14 is inserted into the long hole 4*k*, the through-holes 16*a*, and shaft hole 3*b* to hold the second arm 3 rotatably and movably toward the front and back direction to the first arm 2.

The adjustment mechanism in the stay 15 of the second embodiment is configured, by rotating the adjustment screw 13, to move the second arm 3 along the front and back direction with respect to the case 4. By such adjustment mechanism, since the cam face 3*d* of the second arm 3 can be moved along the front and back direction to the pressing part 9 such that the torque acting to the second arm 3 is also changed likely to the stay 1 of the first embodiment.

As described as far, the present invention has been described using particular embodiments, however, the stay of the present invention is not limited to the above described embodiments and can include ones that various modifications are incorporated. For example, though the stay 1 is one that the driver and so on for rotating the adjustment screw 13 is inserted from the front side of the case 4, as shown in FIG. 11, the configured may be possible for allowing the driver and so on to insert from the back side of the case 4 by reversing the direction of the adjustment screw 13. Furthermore, as shown in FIG. 12, an adjustment function for adjusting the magnitude of the assist force may be added by changing the spacing between the spring receiver 19 and the slider 7 by disposing a base 17 disposed at the lower part of the case 4, a second adjustment screw 18 attached rotatably to the base 17, and a spring receiver 19 moving to the up and down direction in the case 4 by rotating the second adjustment screw 18. Furthermore, when attaching the stay 1 of the first embodiment, according to the above described embodiment, the shortcoming of careless closing of the door 102 can be prevented by inserting the drivers and so on into the upper through-hole 4*e* of the case 4 together with the through-hole 3*c* of the second arm 3, alternatively, as shown in FIG. 13 and FIG. 14, the configuration may be possible by placing a pin 4*n* to the case 4 while disposing a hook 3*e* having a C-shape in its plane view to the second arm 3; when the door 102 is opened largely as shown in FIG. 14, the hook 3*e* engages with the pin 4*n* to hold the second arm 3 with respect to the case 4. Besides, shapes of the cam face 3*d* is not limited to those illustrated and optional modifications may be possible depending on desired assisting functions and free-stop functions. For example, for securely keeping the state of door closing, a concave part that allows the pressing part 9 to engage when the opening angle of the door 102 is to be 0 degree may be disposed to the cam face 3*d*. Furthermore, when moving the pressing part 9 to the slider 7 in the first embodiment, for example, it may be configured that the through-hole 7*c* disposed at the front wall 7*a* of the slider 7 is formed as a female screw part and the adjustment screw 13 screws to this female screw, and lastly the top part of the adjustment screw 13 may be supported rotatably to the pressing part 9. Furthermore, in the second embodiment, when moving the second arm 3 along the front and back direction to the case 4, it may be configured that, for example, the screw hole 4*m* is configured to the through-hole and the adjustment screw 13 is supported rotatably to the through-hole, and lastly the adjustment screw 13 screws into the second arm 3 (or bracket 16).

DESCRIPTION OF SIGNS AND NUMERALS

1: stay
2: first arm
3: second arm
4: case
3*d*: cam face
7: slider
8: spring (resilient body)
9: pressing part
10: adjustment mechanism
11: anti-loosing member
12: receiver member
13: adjustment screw
101: body
102: door

The invention claimed is:

1. A stay comprising:

a first arm rotatably connected to any one of a body or a door openable to the body, a second arm, one end of the second arm being rotatably connected to the first arm and the other end being connected to the other one of the body or the door, the first arm including a resilient body, a slider urged by the resilient body to the second arm, a case supporting slidably the slider toward the second arm, and a pressing part being abutted and pressured onto a cam face disposed to the second arm by the slider, an adjustment mechanism changing a pressing position between the cam face and the pressing part to a crossing direction with respect to a sliding direction of the slider and a rotation shaft axis direction of the second arm along which the second arm rotates around a shaft part, wherein the adjustment mechanism includes an adjustment screw being screwed to any one of the pressing part or the slider while being supported rotatably by the other one, and making the pressing part and the slider move relatively, and wherein the pressing part includes an anti-loosing member abutting to the adjustment screw, the anti-loosing member is configured to prevent the adjusting screw from loosening with respect to the pressing part.

2. The stay of claim 1, wherein the adjustment mechanism includes a receiver member being placed between the slider and the pressing part while supporting the pressing part slidably, and being disposed at an opposite side that is opposite to a side to which urging force of the resilient body is applied to receive the urging force of the resilient body.

3. The stay of claim 1, wherein the adjustment mechanism includes an adjustment screw being screwed to any one of the case and the second arm while supported rotatably by any other one, and making the case and the second arm move relatively.

* * * * *